US005584676A

United States Patent [19]

Dreiman

[11] Patent Number: 5,584,676

[45] Date of Patent: Dec. 17, 1996

[54] COMPRESSOR DISCHARGE VALVE HAVING A GUIDED SPHERICAL HEAD

[75] Inventor: Nelik I. Dreiman, Tipton, Mich.

[73] Assignee: Tecumseh Products Company, Tecumseh, Mich.

[21] Appl. No.: 330,198

[22] Filed: Oct. 27, 1994

[51] Int. Cl.[6] ..... F04B 39/10

[52] U.S. Cl. ..... 417/569; 417/570; 417/902; 137/540; 137/533.27; 251/368

[58] Field of Search ..... 417/562, 566, 417/570, 902, 569; 137/533.27, 540; 251/368

[56] References Cited

U.S. PATENT DOCUMENTS

| | | | |
|---|---|---|---|
| 640,488 | 1/1900 | Philpott | 417/569 |
| 867,702 | 10/1907 | Clarke . | |
| 1,652,978 | 12/1927 | Enock . | |
| 1,922,379 | 8/1933 | Longfellow . | |
| 2,169,052 | 8/1939 | Lindsey | 137/540 |
| 2,177,601 | 5/1938 | Browne . | |
| 2,503,139 | 4/1950 | Pascal . | |
| 2,505,139 | 4/1950 | Pascal . | |
| 2,676,608 | 4/1954 | Svenson . | |
| 2,767,608 | 4/1954 | Svenson . | |
| 2,935,995 | 5/1960 | Rucker . | |
| 2,998,827 | 9/1961 | Cook . | |
| 3,148,697 | 9/1964 | Carr . | |
| 3,244,195 | 4/1966 | Wanner . | |
| 3,324,673 | 6/1967 | Lindahl . | |
| 3,424,198 | 1/1969 | Erbach . | |
| 3,457,949 | 7/1969 | Coulter . | |
| 4,172,465 | 10/1979 | Dashner . | |
| 4,212,316 | 7/1980 | Basch . | |
| 4,284,391 | 8/1981 | Williamson . | |
| 4,329,125 | 5/1982 | Chambers . | |
| 4,368,755 | 1/1983 | King . | |
| 4,445,534 | 5/1984 | King . | |
| 4,469,126 | 9/1984 | Simpson . | |
| 4,478,243 | 10/1984 | King . | |
| 4,537,566 | 8/1985 | Blass . | |
| 4,543,989 | 10/1985 | Lorson . | |
| 4,548,234 | 10/1985 | Prenger . | |
| 4,711,269 | 12/1987 | Sule . | |
| 4,723,896 | 2/1988 | Fritchman . | |
| 4,834,632 | 5/1989 | Gatecliff . | |
| 4,948,349 | 8/1990 | Koiwa . | |
| 4,955,796 | 9/1990 | Terwilliger . | |
| 5,035,261 | 7/1991 | Koiwa . | |
| 5,080,130 | 1/1992 | Terwilliger . | |
| 5,106,278 | 4/1992 | Terwilliger . | |
| 5,149,254 | 9/1992 | Riffe . | |
| 5,183,075 | 2/1993 | Stein . | |
| 5,203,857 | 4/1993 | Terwilliger . | |
| 5,346,373 | 9/1994 | Riffe | 417/569 |

FOREIGN PATENT DOCUMENTS

| | | | |
|---|---|---|---|
| 634619 | 1/1962 | Canada | 137/540 |
| 1453528 | 9/1963 | Germany . | |
| 290240 | 5/1991 | Germany . | |
| 54-47111 | 4/1979 | Japan . | |
| 54-159701 | 12/1979 | Japan . | |
| 57-184769 | 11/1982 | Japan . | |
| 58-221078 | 12/1983 | Japan . | |
| 2069101 | 8/1981 | United Kingdom | 417/566 |
| 2217814 | 11/1989 | United Kingdom | 137/540 |

*Primary Examiner*—Timothy Thorpe
*Assistant Examiner*—Roland G. McAndrews, Jr.
*Attorney, Agent, or Firm*—Baker & Daniels

[57] ABSTRACT

A compressor assembly is disclosed including a compressor mechanism mounted within a hermetically sealed housing. A cylinder block contains a reciprocating piston along with a discharge valve assembly. The discharge valve assembly includes a valve plate with a spherically shaped valve seat that a similarly spherically shaped solid polymeric discharge valve member seats thereto. A retaining mechanism including two upstanding pins are used to guide valve movement.

15 Claims, 3 Drawing Sheets

COMPRESSOR DISCHARGE VALVE HAVING A GUIDED SPHERICAL HEAD

BACKGROUND OF THE INVENTION

The present invention relates generally to a hermetic compressor and, more particularly, to a compressor having a reciprocating piston compressing fluid for flow past a discharge valve assembly.

A hermetic compressor comprises a hermetically sealed housing having a compressor mechanism mounted therein. The compressor mechanism may include a crankcase or cylinder block defining a compression chamber in which gaseous refrigerant is compressed and subsequently discharged.

A disadvantage to prior compressor designs is that there is always a certain volume left in the cylinder when the piston is at top dead center position. This volume of gas never leaves the cylinder but is repetitively compressed and re-expanded during the reciprocation of the piston. Re-expansion volume causes a loss of energy efficiency in a compressor.

In prior art compressors utilizing discharge valve designs disclosed, for example, in U.S. Pat. Nos. 2,117,601 and 4,834,632, the discharge valve member is mounted adjacent to and is seated against a valve plate and is axially displaceable in a space above the valve plate limited in movement by the valve plate top surface and a valve retainer.

It has long been recognized that valve design plays a crucial role in reliable and efficient operation of compressors. The reliability depends upon the dynamic behavior of the valve and the properties of the material from which the valve is made. Use of steel in ring or reed type valves is common in prior art compressors. The ability of some valve steels to resist the stress created by repeated bending and impacts caused by collision of a valve member with its seat is one of the essential properties of prior art valve materials. A valve material with higher damping characteristics would absorb induced stress peaks more efficiently, minimize valve damage and reduce noise generated by such impacts.

Prior steel valve members deformed by aerodynamic forces will form valve member to valve seat gaps, the dimensions and shape of which vary. Most prior compressors have a valve plate including surfaces at right angles to the outer face of the plate. Such valving system designs have a clearance volume at the sharp edges of the discharge port of the valve plate creating a turbulent flow and vortices due to the separation of the flow boundary layer at the valve seat outlet. This phenomenon affects the pressure distribution upon the valve surface, while increasing pressure losses and consequently reducing the performance of the compressor.

An objective of the proposed invention is to provide a reliable discharge valve system with an improved design for gas passage to increase valve flow area and minimize the pressure drop and cylinder reexpansion volume. The present invention also reduces turbulence formation, decreases noise generated by the valving system and is inexpensive to manufacture.

SUMMARY OF THE INVENTION

The present invention overcomes the aforementioned problems associated with prior art compressors by providing a discharge valve assembly with an increased valve flow area and a minimum pressure drop and cylinder reexpansion volume.

Generally, the invention provides a discharge valve plate with a port opening forming a valve seat shaped as a side surface of a sphere. A discharge valve member or valve head substantially shaped as a part-spherical segment seats and disengages from the valve seat port opening to create a smoothly operating valve system.

More specifically, a polymeric spherical solid valve member having high damping characteristics selectively engages the spherical shaped valve port. The valve member has two radial recesses that guide it for rectilinear movement on retaining pins, while a spring is utilized for creating a closing bias on the discharge valve.

An advantage of the discharge valve system of the present invention is that the spherical valve member has its entire seating surface immediately exposed to fluid pressure generated within the compression chamber on opening. The curved shape of the exposed valve member surface has a larger surface than any exposed discharge surface of the same diameter prior art discharge valve member. The maximum exposure of the spherical valve member during opening to compressed fluid accelerates valve opening thereby increasing the performance of the compressor while decreasing possible throttling effects.

Another advantage of the discharge valve system of the present invention is that use of retaining pins within radial recesses in the discharge valve to guide valve movement provides that no special valve alignment is necessary at compressor assembly time. During assembly after the retainer pins are in place, the discharge valve member is slid down upon the pins, automatically aligning the valve member with the valve port thereby preventing misalignment.

A further advantage of the discharge valve system of the present invention is that the shape of the valve seat along with the radiusing of the valve plate port edges minimizes the pressure drop across the opening allowing smooth flow of gas since there is an absence of sharp turns. This structure improves the efficiency of the compressor and prevents valve flutter thereby eliminating intermittent chattering noises.

Another advantage of the discharge valve system of the present invention in the preferred form of the invention, the valve plate port and valve member have the same particular radius of curvature on their spherical segments. This structure ensures that any shifting, cocking or tilting of the valve member at closing will not effect the valve sealing and seating ability.

Another advantage of the discharge valve system of the present invention is that the polymeric solid valve member eliminates bending and reduces valve noise during operation. By forming the valve member of a polymeric material having high damping characteristics, bending of the valve member is prevented thereby eliminating flexoral stress, a main source of failure on prior art reed or ring type discharge valves. The only significant stress on the discharge valve of the present invention is impact of the valve member against the valve seat and stop.

The invention, in one form includes a compressor for compressing refrigerant including a cylinder block having a bore disposed within a compressor housing. A piston is disposed within the bore and drivingly connected to a piston drive mechanism for reciprocation within the bore. A discharge valve assembly defines a discharge port having a concave, spherically shaped valve seat. The discharge valve assembly attaches over the bore and includes a discharge valve member having a spherically shaped sealing surface overlying and in engagement with the discharge valve seat.

The spherically shaped sealing surface engaging the valve seat is immediately exposed to refrigerant during discharge valve opening.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
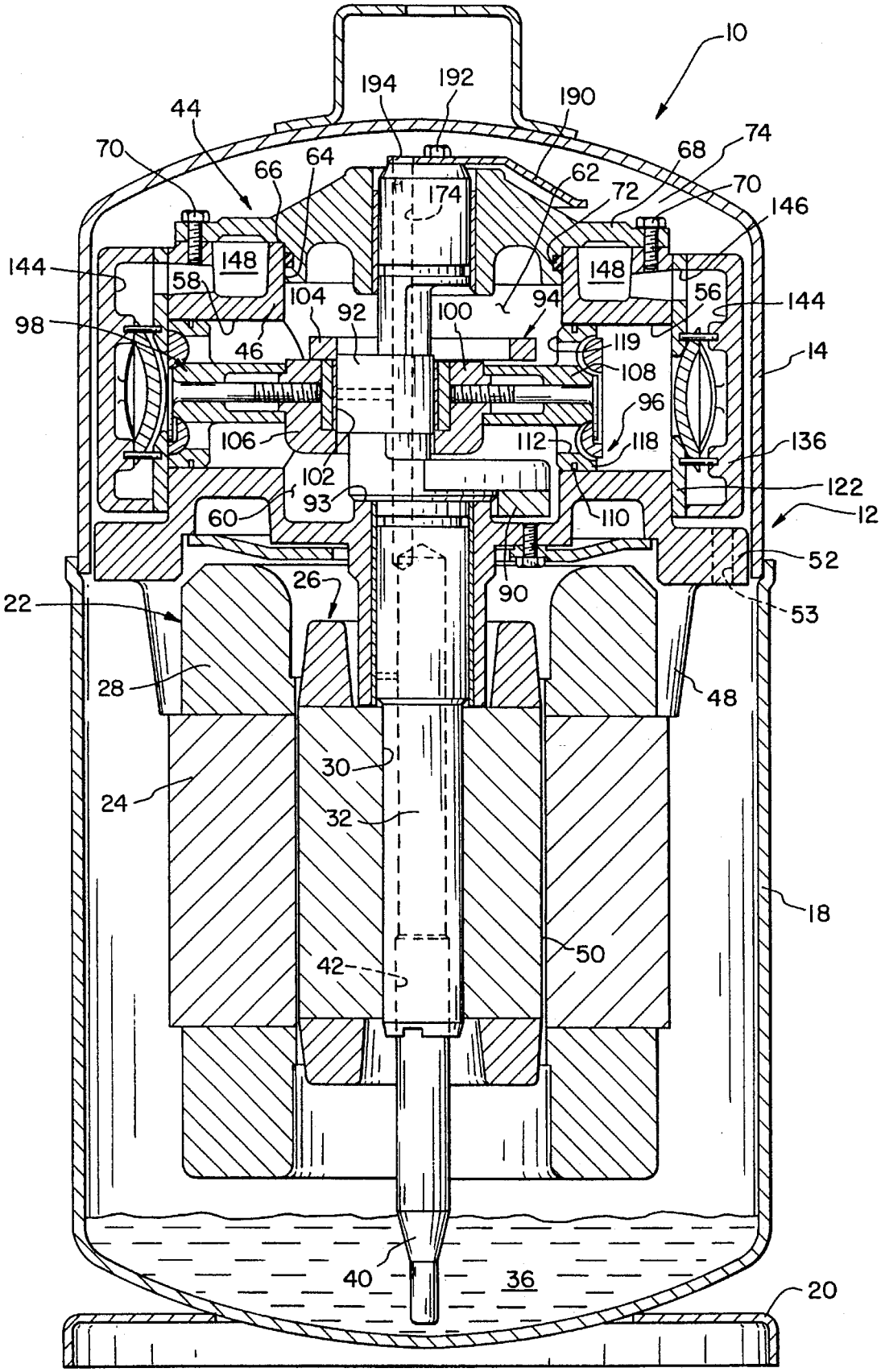
FIG. 1 is a longitudinal cross sectional view of a compressor of the type to which the present invention pertains.

Corresponding reference characters indicate corresponding parts throughout the several views. The exemplifications set out herein illustrate preferred embodiments of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a compressor assembly 10 is shown having a housing generally designated at 12. The housing has a top portion 14 and a bottom portion 18. The two housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. Stator 24 is provided with windings 28. Rotor 26 has a central aperture 30 provided therein into which is secured a crankshaft 32 by an interference fit. A terminal cluster (not shown) is provided in bottom portion 18 or housing 12 for connecting the compressor to a source of electric power.

Compressor assembly 10 also includes an oil sump 36 located in bottom portion 18. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment shown in FIG. 1, is a scotch yoke compressor mechanism generally designated at 44. A complete description of a basic scotch yoke compressor design is given in U.S. Pat. No. 4,838,769 assigned to the assignee of the present invention and expressly incorporated herein by reference.

Compressor mechanism 44 comprises a crankcase or cylinder block 46 including a plurality of mounting lugs 48 to which motor stator 24 is attached such that there is an annular air gap 50 between stator 24 and rotor 26. Crankcase 46 also includes a circumferential mounting flange 52 attached, or by an interference but or other means to housing 12. The lower portion of crankcase 46 and mounting flange 52 serve to divide the interior of the housing 12 into an upper chamber in which the compressor mechanism 44 is mounted and a lower chamber in which motor 22 is disposed. A passage 53 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, and O-ring seal 72 isolates suction cavity 60 from a discharge pressure space 74 defined by the interior of housing 12.

Crankshaft 32 is rotatably journalled in crankcase 46, and extends through suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinder bores 56 and 58, respectively.

Scotch yoke mechanism 94 comprises a slide block 100 including a cylindrical bore 102 in which eccentric portion 92 is journalled. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98 of the present invention, whereby when piston assembly 96 is at a bottom dead center position, piston assembly 98 will be at a top dead center position.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36.

Referring once again to piston assemblies 96 and 98 of the present invention, each piston assembly comprises a piston member 108 that reciprocates within a cylinder bore to compress gaseous refrigerant therein. Piston member 108 includes an annular piston ring 110. Suction ports 112 extending through piston member 108 from a front surface 118 to a rear surface 119 allow suction gas within suction cavity 60 to enter cylinder 56 on the compression side of piston 108.

A discharge valve assembly 120 is disposed over each cylinder for example as shown with cylinder 56. Discharge valve assembly 120 includes a valve plate 122 having an annular port 124. A valve seat 126 is formed about annular port 124 as a side surface of a spherical segment or sphere.

Discharge valve member 128, engagable into valve seat 126, is a solid member formed of a polymeric material. Discharge valve member 128 is preferably formed from a high performance polymeric material capable of withstanding a large temperature range, such as –40° F. to 500° F., and impact induced stresses. Preferable polymers include Vespel, available from Dupont Company, Victrex, produced by ICI Company, and Kadel, produced by Amoco Company, having tensile strengths of approximately $32\times10^3$ PSI, high impact strength and low water absorption. These polymers also have a high flexural modulus preferably more than $2.5\times10^6$ PSI with high heat distortion temperatures of over 550° F. at approximately 260 PSI.

Figure 4:
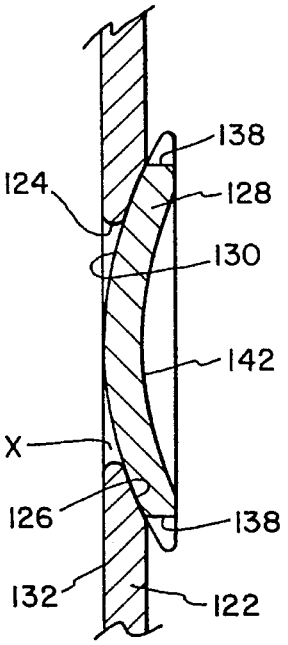
FIG. 4 is an enlarged sectional view of the valve plate and discharge valve member of one form of the invention.

Discharge valve member 128 includes a sealing surface 130 also shaped as a spherical segment that engages valve seat 126. This spherical portion of solid discharge valve member 128 substantially fills at closing annular port 124, reducing the gas reexpansion volume for valve plate 122. As shown in FIG. 4, only the portion labeled X remains as reexpansion volume between discharge valve member 128 and valve member plate 122.

Spherical sealing surface 130 facing cylinder 56 has substantially its complete surface immediately exposed to fluid pressure generated during valve opening. The curved shape of sealing surface 130 exposes a larger surface area than any exposed flat surface of the same diameter prior art discharge valve members. This maximized exposure of spherical valve surface 130 to discharge refrigerant flow accelerates the discharge valve opening thereby increasing compressor efficiency.

Spherical valve seat 126 preferably has the same radius of curvature as that of spherical sealing surface 130. By virtue of their same radii of curvature, shifting, cocking, tilting or other dislocations of valve member 128 during valve closing will not affect its sealing and seating ability. The design of spherical discharge valve member 128 by virtue of its solid member construction prevents bending of the valve member during operation.

Figure 2:
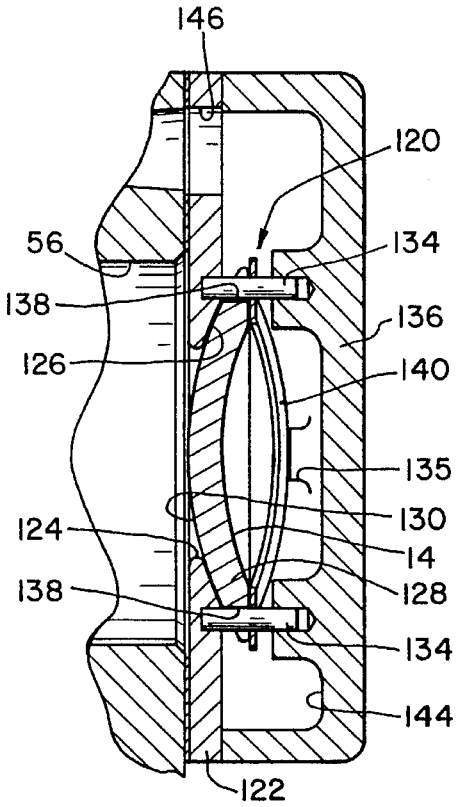
FIG. 2 is an enlarged fragmentary sectional view of the discharge valve assembly of FIG. 1 with the discharge valve in a closed position.
Figure 3:
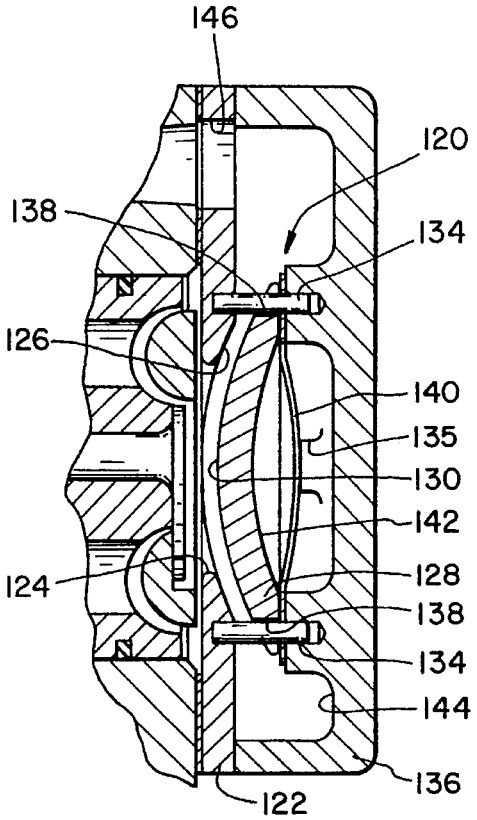
FIG. 3 is an enlarged fragmentary sectional view of the discharge valve assembly of FIG. 1 with the discharge valve in the open position.

As shown in FIGS. 2 through 4, the radial inner edge of annular port 124, is radiused between valve seat portion 126 and a side 132 of valve plate 122. This radius or chamfer additionally smooths fluid flow through valve plate 122 reducing turbulence that may effect compressor efficiency.

Figure 5:
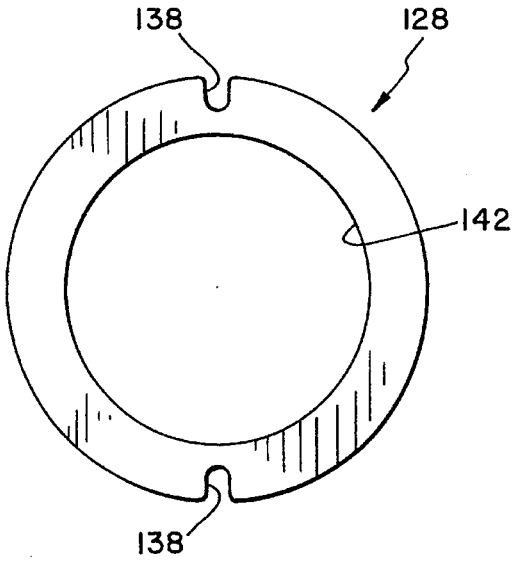
FIG. 5 is a plan view of the discharge valve member of the present invention.
Figure 6:
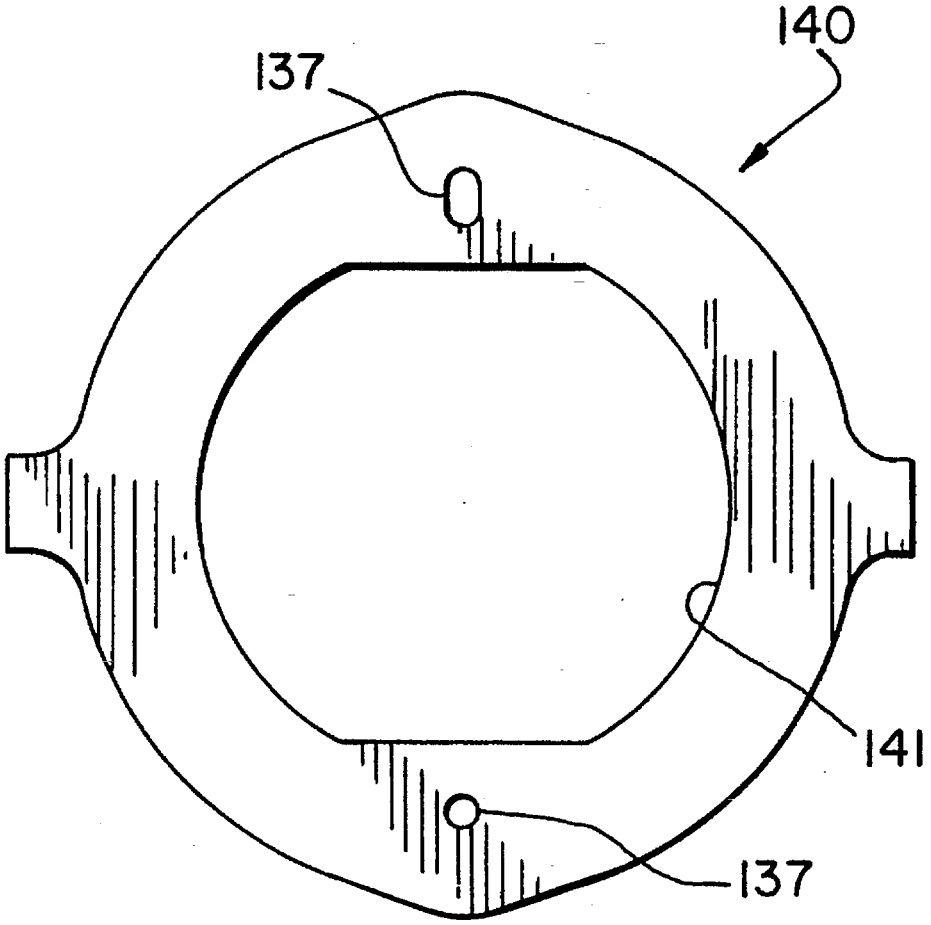
FIG. 6 is a plan view of the discharge valve spring of the present invention.

Discharge valve 128 is retained for reciprocating movement towards and away from valve member plate 122 by two valve plate pins 134 that interfit between and into valve plate 122 and an overlying cylinder head 136. As shown in FIG. 5, discharge valve 128 includes two diametrically opposed semicircular recesses 138 that substantially engage about and slide on valve plate pins 134 during compressor operation. Pins 134 provide a guide for the reciprocating motion of discharge valve member 128.

An arcuate, annular cantilever shock absorbing spring 140 as shown in FIGS. 2–4 is disposed between discharge valve member 128 and cylinder head 136. Valve plate pins 134 also serve to guide and locate spring 134 by engaging holes 137 therein during compressor operation.

This particular arrangement of valve plate pins 134 permits easy assembly since alignment of valve plate 122, discharge valve member 128 and cylinder head 136 is accomplished automatically by insuring all of discharge valve assembly 120 is located upon pins 134. Spring 140 is used to bias valve 128 into valve seat 126 and cushion the impacting surfaces of discharge valve member 128 and web member 135 of cylinder head 136.

The curved form of spring 140 accomplishes in a simple fashion, to rapidly increase the spring rate during final stages of deflection and reciprocation of discharge valve member 128 without the possibility of over stressing itself, similar to the valve spring disclosed in U.S. Pat. No. 4,834,632. Alternatively, other spring designs may be utilized. To decrease the weight of spring 140, a central bore 141 is formed therein.

In an attempt to reduce the weight of discharge valve member 128, a spherical cavity 142 is formed along the backside or rear of discharge valve member 128. Cavity 142 also increases the surface area effected by the pressure within the cylinder head cavity or plenum 144. This cavity structure will tend to accelerate closure of discharge valve member 128 due to increased area to which fluid pressure is applied.

During compressor operation, discharge valve member 128 reciprocates within a discharge plenum 144 formed by cylinder header 136. Discharge gases pass through discharge passageway 146 into a muffler cavity 148 within cylinder block 46. These discharge gases eventually make their way to the discharge pressure space 74 within compressor housing 12 and then onto an associated refrigeration system.

In operation, piston assembly 96 will reciprocate within cylinder bore 56. As piston assembly 96 moves from bottom dead center position to top dead center position on its compression, gaseous refrigerant within cylinder bore 56 will be compressed and forced through discharge valve port 124 and bias discharge valve member 128 against spring 140 and toward cylinder head. When discharge valve member 128 is in the open position, as shown in FIG. 3, compressed discharge gas will smoothly pass by spherical surface 130. At this time discharge valve member 128 acts as a radial diffuser allowing fluid to pass by in all radial directions relative to discharge valve member movement. After piston assembly 96 has reached top dead center and retreats from discharge valve member 128, spring 140 will bias close discharge valve member 128 against valve seat 126. Because smooth spherical surface 130 is preferably larger in diameter than valve seat 126, any cocking or misalignment of discharge valve member 128 will not effect valve seating.

It is evident that the valve system described herein is applicable to other types of compressors than scotch yoke compressors. The new valve system may be utilized in single or double reciprocating piston compressors and rotary compressors as well. The present invention would reduce re-expansion and increase discharge valve opening and closing speed in these compressors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor for compressing refrigerant, said compressor comprising:

a housing;

a cylinder block having a bore, said cylinder block disposed within said housing;

a piston disposed within said bore for reciprocation therein;

a piston drive mechanism drivingly connected with said piston; and a discharge valve assembly defining a discharge port having a concave spherically shaped valve seat, said discharge valve assembly attached over said bore opposite said piston and including a polymeric discharge valve member having a spherically shaped sealing surface overlying and engagable with said discharge valve seat and a concave rear surface;

said discharge valve member having two diametrically opposed recesses, said discharge valve assembly including two pin members, whereby said discharge valve member is guided for rectilinear movement between said pin members by each said pin member interfitting within a respective said recess.

2. The compressor of claim 1 in which said discharge valve assembly is arranged so that during a period of compression said valve member spherically shaped sealing surface cooperates with said concave spherically shaped valve seat to form a radial diffuser for refrigerant passing through said discharge port whereby refrigerant turbulence and valve flutter are reduced.

3. The compressor of claim 1 in which said discharge valve concave rear surface defines a cavity which is maximized to reduce valve member mass whereby valve closure is accelerated.

4. The compressor of claim 1 in which an arcuate spring is disposed adjacent said discharge valve member and adapted to bias said discharge valve member toward said valve seat.

5. A compressor for compressing refrigerant, said compressor comprising:

a housing;

a cylinder block having a bore, said cylinder block disposed within said housing;

a piston disposed within said bore for reciprocation therein;

a piston drive mechanism drivingly connected with said piston; and a discharge valve assembly defining a discharge port having a concave spherically shaped valve seat, said discharge valve assembly attached over said bore opposite said piston and including a polymeric discharge valve member having a spherically shaped sealing surface overlying and engagable with said discharge valve seat and a concave rear surface, said spherically shaped valve seat and said spherically shaped sealing surface having the same radius of curvature;

said discharge valve member having two diametrically opposed recesses, said discharge valve assembly including two pin members, whereby said discharge valve member is guided for rectilinear movement between said pin members by each said pin member interfitting within a respective said recess.

6. A compressor for compressing refrigerant, said compressor comprising:

a housing;

a cylinder block having a bore, said cylinder block disposed within said housing;

a piston disposed within said bore for reciprocation therein;

a piston drive mechanism for reciprocating said piston within said bore; and a discharge valve assembly defining a discharge port having a concave spherically shaped valve seat, said discharge valve assembly attached over said bore opposite said piston and including a polymeric discharge valve member having a spherically shaped sealing surface overlying and engagable with said discharge valve seat and a concave rear surface, said spherically shaped sealing surface immediately fully exposed to refrigerant when said discharge valve member disengages from said discharge valve seat;

said discharge valve member having two diametrically opposed recesses, said discharge valve assembly including two pin members, whereby said discharge valve member is guided for rectilinear movement between said pin members by each said pin member interfitting within a respective said recess.

7. The compressor of claim 6 in which said discharge valve assembly is arranged so that during a period of compression said valve member spherically shaped sealing surface cooperates with said concave spherically shaped valve seat to form a radial diffuser for refrigerant passing through said discharge port whereby refrigerant turbulence and valve flutter are reduced.

8. The compressor of claim 6 in which said discharge valve assembly includes a cylinder head covering said discharge valve port and said discharge valve member connected to said cylinder block, and an annular arcuate spring steel member disposed between said discharge valve member and said cylinder head to bias said discharge valve member into engagement with said discharge valve seat.

9. The compressor of claim 6 in which said discharge valve member concave rear surface defines a rear cavity whereby valve closure is accelerated.

10. A compressor for compressing refrigerant, said compressor comprising:

a housing;

a cylinder block having a bore, said cylinder block disposed within said housing;

a piston disposed within said bore for reciprocation therein;

a piston drive mechanism for reciprocating said piston within said bore; and a discharge valve assembly defining a discharge port having a concave spherically shaped valve seat, said discharge valve assembly attached over said bore opposite said piston and including a polymeric discharge valve member having a spherically shaped sealing surface overlying and engagable with said discharge valve seat and a concave rear surface, said spherically shaped valve seat and said spherically shaped sealing surface having the same radius of curvature, said spherically shaped sealing surface immediately fully exposed to refrigerant when said discharge valve member disengages from said discharge valve seat;

said discharge valve member having two diametrically opposed recesses, said discharge valve assembly including two pin members, whereby said discharge valve member is guided for rectilinear movement between said pin members by each said pin member interfitting within a respective said recess.

11. A compressor for compressing refrigerant, said compressor comprising:

a housing;

a cylinder block having a bore, said cylinder block disposed within said housing;

a piston disposed within said bore for reciprocation therein;

a piston drive mechanism drivingly connected with said piston; and a discharge valve assembly defining a discharge port having a concave spherically shaped valve seat, said discharge valve assembly attached over said bore opposite said piston and including a discharge valve member having a spherically shaped sealing surface overlying and engagable with said discharge valve seat and a concave rear surface, said discharge valve member diameter substantially the same as said bore diameter.

12. The compressor of claim 11 in which said discharge valve member concave rear surface defines a cavity which is maximized to reduce valve member mass whereby valve closure is accelerated.

13. The compressor of claim 11 in which said discharge valve assembly includes a cylinder head covering said discharge valve port and said discharge valve member connected to said cylinder block, and an annular arcuate spring steel member disposed between said discharge valve member and said cylinder head to bias said discharge valve member into engagement with said discharge valve seat.

14. The compressor of claim 11 in which said spherically shaped valve seat and said spherically shaped sealing surface have the same radius of curvature.

15. The compressor of claim 14 in which said discharge valve member includes two diametrically opposed recesses, said discharge valve assembly including two pin members, and said discharge valve member guided for rectilinear movement between said pin members by each said pin member interfitting within a respective said recess.

* * * * *